US011107320B2

(12) United States Patent
Soo

(10) Patent No.: US 11,107,320 B2
(45) Date of Patent: Aug. 31, 2021

(54) METHOD AND APPARATUS FOR PROVIDING A PRIZE BASED ON VARIABLE ACCUMULATION RATES

(71) Applicant: Aristocrat Technologies Australia Pty Limited, North Ryde (AU)

(72) Inventor: Paul Soo, Dee Why (AU)

(73) Assignee: Aristocrat Technologies Australia Pty Limited, North Ryde (AU)

( * ) Notice: Subject to any disclaimer, the term of this patent is extended or adjusted under 35 U.S.C. 154(b) by 0 days.

(21) Appl. No.: 16/392,192

(22) Filed: Apr. 23, 2019

(65) Prior Publication Data

US 2019/0251790 A1 Aug. 15, 2019

Related U.S. Application Data

(63) Continuation of application No. 14/468,753, filed on Aug. 26, 2014, now Pat. No. 10,319,183.

(30) Foreign Application Priority Data

Aug. 27, 2013 (AU) ..... 2013903240

(51) Int. Cl.
*G07F 17/32* (2006.01)

(52) U.S. Cl.
CPC ..... *G07F 17/3244* (2013.01)

(58) Field of Classification Search
CPC ..... G07F 17/3244
See application file for complete search history.

(56) References Cited

U.S. PATENT DOCUMENTS

| | | | | |
|---|---|---|---|---|
| 5,816,918 | A | 10/1998 | Kelly et al. | |
| 6,293,865 | B1 | 9/2001 | Kelly et al. | |
| 6,857,959 | B1 | 2/2005 | Nguyen | |
| 2004/0204247 | A1 | 10/2004 | Walker et al. | |
| 2005/0176498 | A1 | 8/2005 | Nguyen | |
| 2006/0003826 | A1 | 1/2006 | Walker et al. | |
| 2006/0194630 | A1 | 8/2006 | Pellegrini et al. | |
| 2008/0227538 | A1 | 9/2008 | Kelly et al. | |
| 2009/0124320 | A1 * | 5/2009 | DeWaal | G07F 17/3258 463/16 |
| 2009/0124361 | A1 | 5/2009 | Gilmore | |

(Continued)

OTHER PUBLICATIONS

Examination report No. 1 for Australian Application No. 2018205176, dated Apr. 3, 2019.

(Continued)

*Primary Examiner* — Corbett B Coburn
(74) *Attorney, Agent, or Firm* — McAndrews, Held & Malloy, Ltd.

(57) ABSTRACT

A method for providing a prize to a player. The method includes displaying a plurality of prize identifiers and activating a prize associated with one of the plurality of prize identifiers when a plurality of reward points accumulated towards the prize reaches a threshold of a corresponding prize identifiers. The method also includes determining a first proportion of a plurality of proportions associated with a first prize identifier at a first accumulation rate, and a second proportion of the plurality of proportions associated with a second prize identifier at a second accumulation rate. The first accumulation rate is different from the second accumulation rate.

24 Claims, 12 Drawing Sheets

(56) References Cited

U.S. PATENT DOCUMENTS

2011/0086700 A1* 4/2011 Walker ..... G07F 17/32
463/27

OTHER PUBLICATIONS

Examination report No. 1 for Australian Application No. 2014216053, dated Sep. 4, 2015.
Examination report No. 1 for Australian Application No. 2016228226, dated 13 Jul. 17.

* cited by examiner

METHOD AND APPARATUS FOR PROVIDING A PRIZE BASED ON VARIABLE ACCUMULATION RATES

RELATED APPLICATIONS

This application claims priority to co-pending U.S. patent application Ser. No. 14/468,753, filed Aug. 26, 2014, which claims priority to Australian Provisional Patent Application No. 2013903240 having an International filing date of Aug. 27, 2013, both of which are incorporated herein by reference in their entirety.

BACKGROUND

This invention relates to promotions in a gaming environment, and more particularly relates to a system and method for promotional messaging and management in a gaming environment.

Gaming machines, such as slot machines, fruit machines, or poker machines, have in recent years become one of the more popular, exciting, and sophisticated wagering activities available at gaming establishments. At the same time, gaming machines have also become a source of greater revenue for gaming establishments. Thus, competition between manufacturers of gaming machines has intensified as competitors vie for business from gaming establishments.

A large gaming establishment typically employs thousands of gaming machines that can be operated simultaneously. A gaming system providing entertaining and enticing features for players would be highly desirable to attract both new and returning players to a gaming establishment. Additionally, gaming establishments often arrange promotions or other events to attract new customers and provide additional incentives for recurring customers.

Gaming establishments traditionally use player tracking software in conjunction with membership clubs to monitor, evaluate and subsequently reward customers in proportion to their loyalty to the establishment. Player tracking systems use points and complimentaries (hereinafter referred to as "comps") as units of measurement and payment. Traditionally, comp is distributed in dollars or prizes, while points are accrued and exchanged for rewards. Thus, there are two parts to player tracking systems: earning (accruing points and comp) and redemption (exchanging points and comp for goods and services).

While the accumulation of points is generally considered successful in attracting players, many players never end up redeeming those points. On the surface this may seem like a good outcome for the establishment, as less is spent providing comps to players, in this also creates an overhang liability. That is, this creates an obligation for the establishment to pay out the comps at a later date. For players that don't regularly redeem, points may accrue over a long period of time so that when the player eventually realises there is a large points balance and wishes to redeem, the establishment has to fund a significant amount of comps in one go to satisfy the overhang liability.

Another issue is that the points may be viewed as being worthless, because the conversion rate is so low. For example in the airline industry, a consumer may be awarded 1 point for every $1 spent in a certain program, such as a credit card rewards program. However, a return trip costing $1000 may require 60,000 points, equating to $60,000 spent to accrue enough points for that trip. Thus for the average consumer, the points conversion rate is so low that it is unlikely to significantly a consumer's spending activities.

Similarly in a gaming establishment, loyalty programs with low points conversion rates is unlikely to influence a player's betting habits.

Thus a system and method is needed to encourage players to redeem rewards points regularly to reduce the overhang liability. Similarly, a system and method is needed to emphasize that rewards points are worthwhile and to encourage players to continue playing in order to accrue points.

BRIEF SUMMARY

According to an aspect of the invention there is provided a method for redeeming a prize in a gaming establishment having at least one gaming machine and at least one game controller, the method comprising the steps of: displaying a plurality of prize buckets on a display, each of said plurality of prize buckets being associated with at least one prize; displaying a plurality of prize level indicators on said display, each prize level indicator being associated with a respective one of said plurality of prize buckets; accumulating a plurality of reward points based on at least one predefined criterion; determining the plurality of accumulated reward points as a proportion of a predefined redemption threshold of points; updating said plurality of prize level indicators based on said determining such that said plurality of prize level indicators is each indicative of a progression towards eligibility to redeem a respective one of the associated plurality of prize buckets; and monitoring said plurality of prize level indicators to determine when at least a first of said plurality of prize level indicators reach said predefined redemption threshold of points and, in response, allow the associated at least one prize to be selectively redeemable from the prize bucket associated with that first prize level indicator.

According to another aspect of the invention, there is provided a system for redeeming a prize in a gaming establishment, the system having at least one gaming machine, comprising: a display for displaying a plurality of prize buckets, each of said plurality of prize buckets being associated with at least one prize, said display also displaying a plurality of prize level indicators, each prize level indicator being associated with a respective one of said plurality of prize buckets; and a gaming controller configured to:

accumulate a plurality of reward points based on at least one predefined criterion, the gaming controller also determining the plurality of accumulated reward points as a proportion of a predefined redemption threshold of points;

update said plurality of prize level indicators based on said determining such that said plurality of prize level indicators is each indicative of a progression towards eligibility to redeem a respective one of the associated plurality of prize buckets; and monitor said plurality of prize level indicators to determine when at least a first of said plurality of prize level indicators reach said predefined redemption threshold of points and, in response, allow the associated at least one prize to be redeemable from the prize bucket associated with that first prize level.

Preferably, the plurality of buckets are grouped into sets based on a predefined range of reward points. A first set of said plurality of buckets is preferably associated with the highest predefined range of reward points. Preferably the first set of buckets is assigned to a first group of players, and wherein a prize associated with said first set of buckets is only redeemable by said first group of players.

When one of the plurality of prize buckets is unlocked, the at least one prize associated with the unlocked prize bucket preferably becomes immediately selectively redeemable. Preferably when the at least one prize becomes immediately selectively redeemable, a notification is sent to a player who is eligible to redeem the prize.

Said notification in one embodiment is an audible alarm. Alternatively, said notification is visual alarm. In still other embodiments, said notification comprises both said audible and said visual alarm. Preferably, said visual alarm includes at least one of: 1) a message, 2) a flashing of the prize level indicators, 3) a changing of colours of at least one element displayed on the display.

The gaming establishment preferably further comprises at least one interface having a plurality of buttons including a first button for viewing said at least one prize, a second button for displaying at least one prize description, and a third button for sending a redemption instruction for selectively redeeming the at least one prize.

Preferably, said third button is deactivated unless at least one prize is redeemable from a prize bucket. Said first button and said second button preferably activates a respective one of a first display area and a second display area, said at least one prize being displayed in said first display area and a description of said at least one prize being displayed in said second display area, and wherein activation of said first and said second display areas are time limited to discourage excessive time spent viewing prizes and descriptions.

In embodiments, each of said at least one interface is collocated with each of said at least one gaming machine. In alternative embodiments, each of said at least one interface is remotely located from each of said at least one gaming machine.

In embodiments, said display on which said plurality of prize buckets and said plurality of prize level indicators are displayed is common to a plurality of said at least one gaming machine. In such embodiments, said plurality of reward points of each of a plurality of players are pooled and wherein in response to the pooled reward points reaching said predefined redemption threshold of points, an associated collective prize is selectively redeemable from a prize bucket associated with that collective prize by said plurality of players.

Preferably, said at least one criterion comprises at least one of: 1) a number of credits wagered on said at least one gaming machine, 2) a length of time played on said at least one gaming machine, 3) a player history, 4) a type of game played 5) a number of credits wagered on any gaming machine in said gaming establishment, and 6) a length of time played in said gaming establishment.

The accumulated plurality of reward points is preferably displayed on said display concurrently with said plurality of prize level indicators.

BRIEF DESCRIPTION

Figure 10:
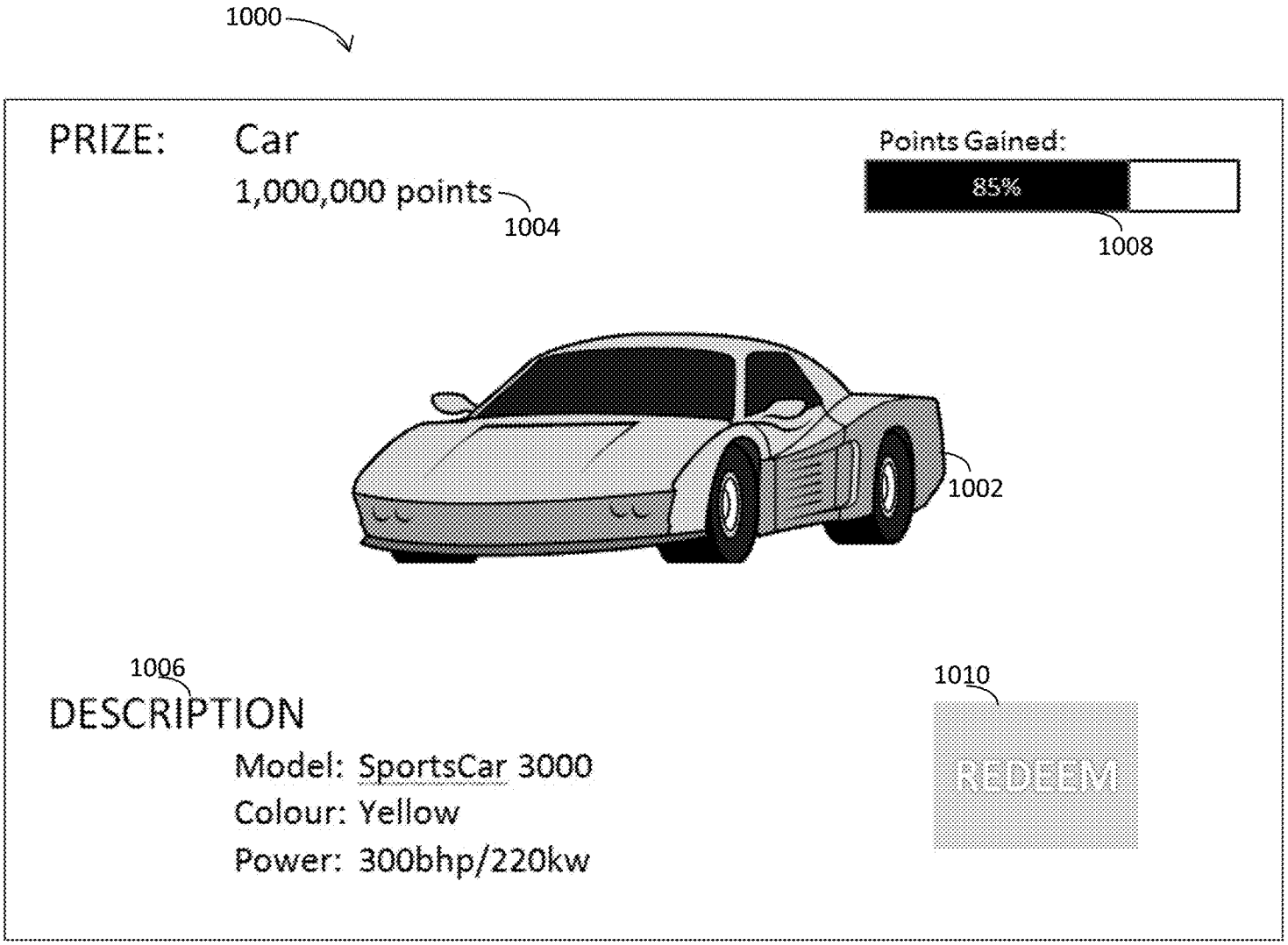
Figure 11:
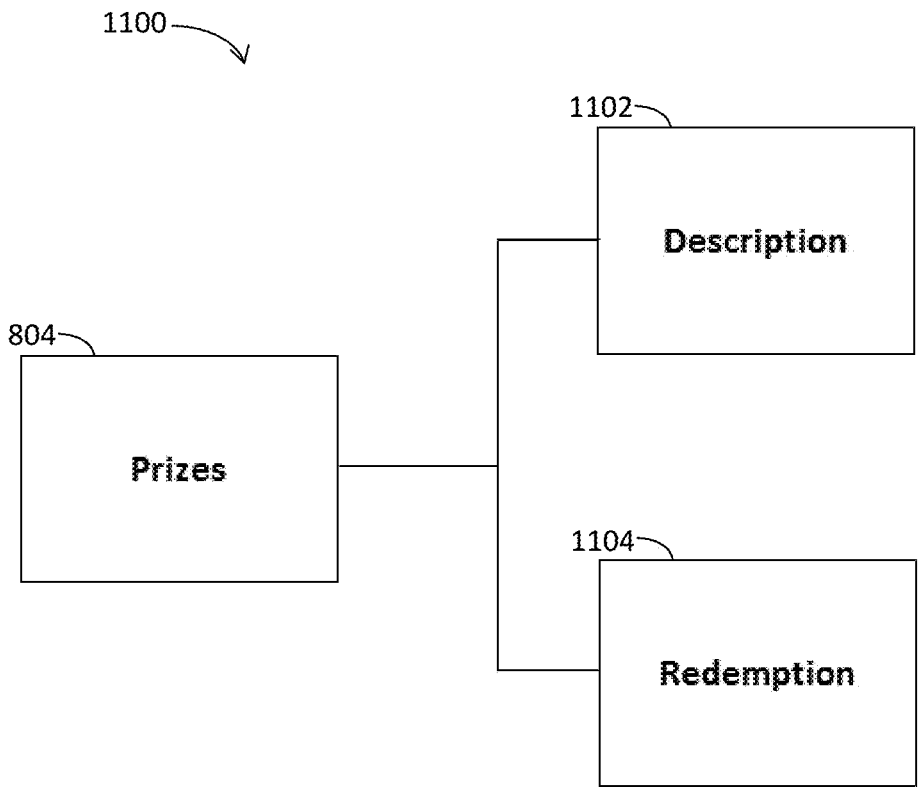
Figure 12:
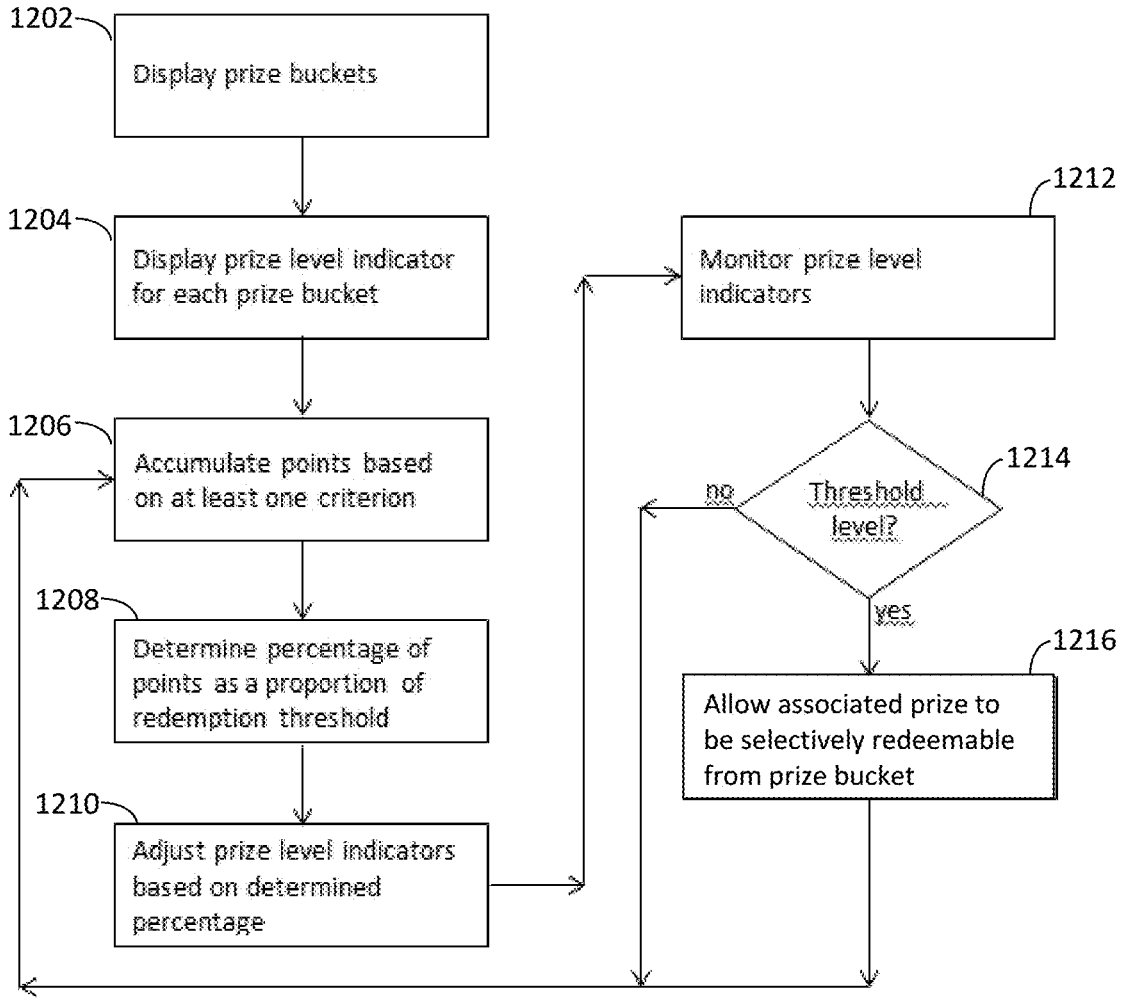

FIGS. 9*a* to 9*d* are representations of prize buckets and prize level indicators displayed on a display of a gaming system in accordance with an embodiment of the present invention;

FIG. 10 is a representation of a prize description and redemption screen in accordance with an embodiment of the present invention;

FIG. 11 is a representation of a prize description and redemption screen in accordance with another embodiment of the present invention; and FIG. 12 is a flow diagram illustrating operation of a gaming system in accordance with an embodiment of the present invention.

The foregoing summary, as well as the following detailed description of certain embodiments of the present invention, will be better understood when read in conjunction with the appended drawings. For the purpose of illustrating the invention, certain embodiments are shown in the drawings. It should be understood, however, that the present invention is not limited to the arrangements and instrumentality shown in the attached drawings.

DETAILED DESCRIPTION

Referring to the drawings, there are shown example embodiments of gaming systems which are arranged to implement a prize redemption system and method. In these embodiments, gaming machines are arranged to implement a standard base game in which a plurality of symbols are selected from a set of symbols, and players are entitled to accrue reward points for play of those games. Once a player accrues sufficient points, the player can selectively choose to redeem a first predefined prize from a plurality of prizes. Alternatively, the player can selectively choose to accrue additional points in order to redeem another predefined prize having a higher value than the first predefined prize.

The player's points balance is viewable by the player on demand or in other embodiments, always viewable on a secondary screen. As will be discussed further below, the player is always kept informed of his or her points balance, as well as any prizes the player is entitled to redeem at any point in time. Furthermore, the player is also given a visual indication of any higher value prizes that may become available to the player in the future, together with the player's progress towards achieving eligibility to redeem those higher value prizes.

The gaming system can take a number of different forms. In a first form, a standalone gaming machine is provided wherein all or most components for implementing the game are present in a player operable gaming machine.

In a second form, a distributed architecture is provided wherein some of the components for implementing the game are present in a player operable gaming machine and some of the components for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in standalone gaming machine mode, "thick client" mode or "thin client" mode depending on the game being played, operating conditions, and so on. Other variations will be apparent to persons skilled in the art.

Figure 1:
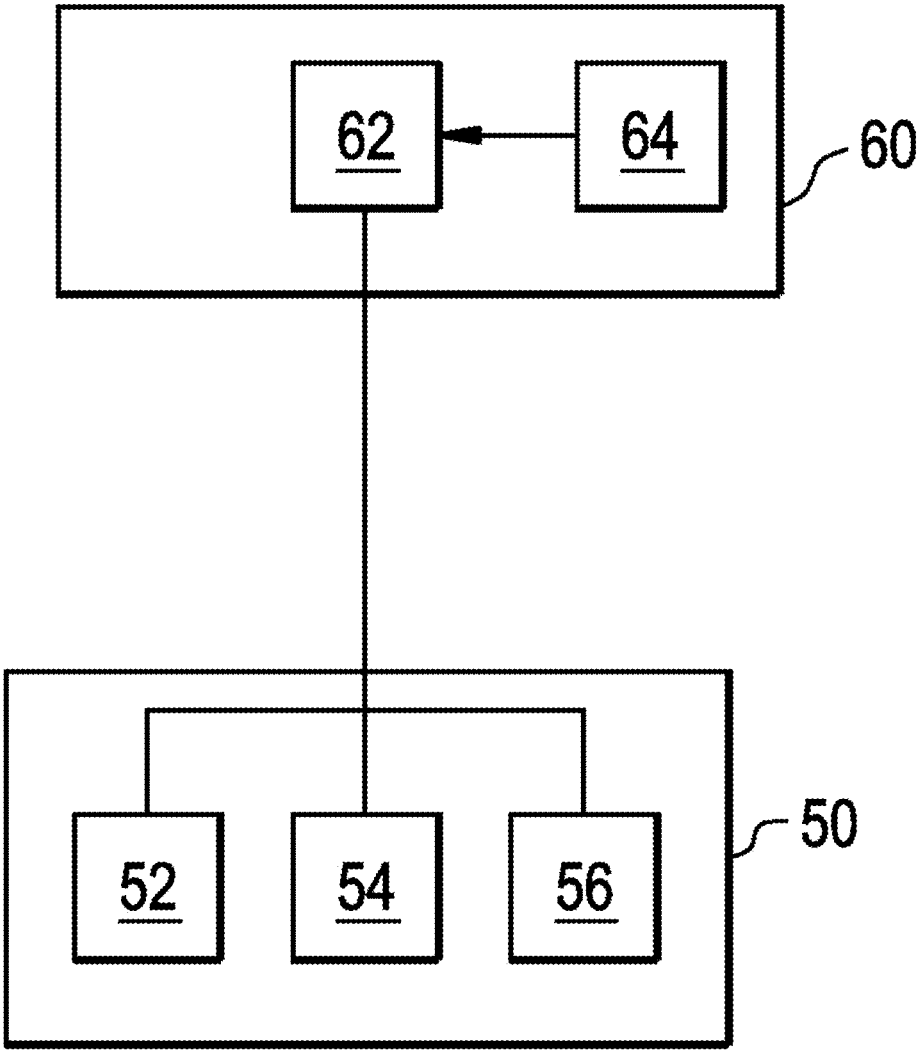
FIG. 1 is a schematic block diagram of core components of a gaming system in accordance with an embodiment of the present invention.

Irrespective of the form, the gaming system includes several core components. At the broadest level, the core components are a player interface 50 and a game controller 60 as illustrated in FIG. 1. The player interface is arranged to enable manual interaction between a player and the gaming system and for this purpose includes the input/output components for the player to enter instructions and play the game.

Components of the player interface may vary from embodiment to embodiment but will typically include a credit mechanism 204 to enable a player to input credits and receive payouts, one or more displays 54 and a game play mechanism 56 that enables a player to input game play instructions.

The game controller 60 is in data communication with the player interface and typically includes a processor 62 that processes the game play instructions in accordance with game play rules and outputs game play outcomes to the display. Typically, the game play instructions are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server.

Figure 2:
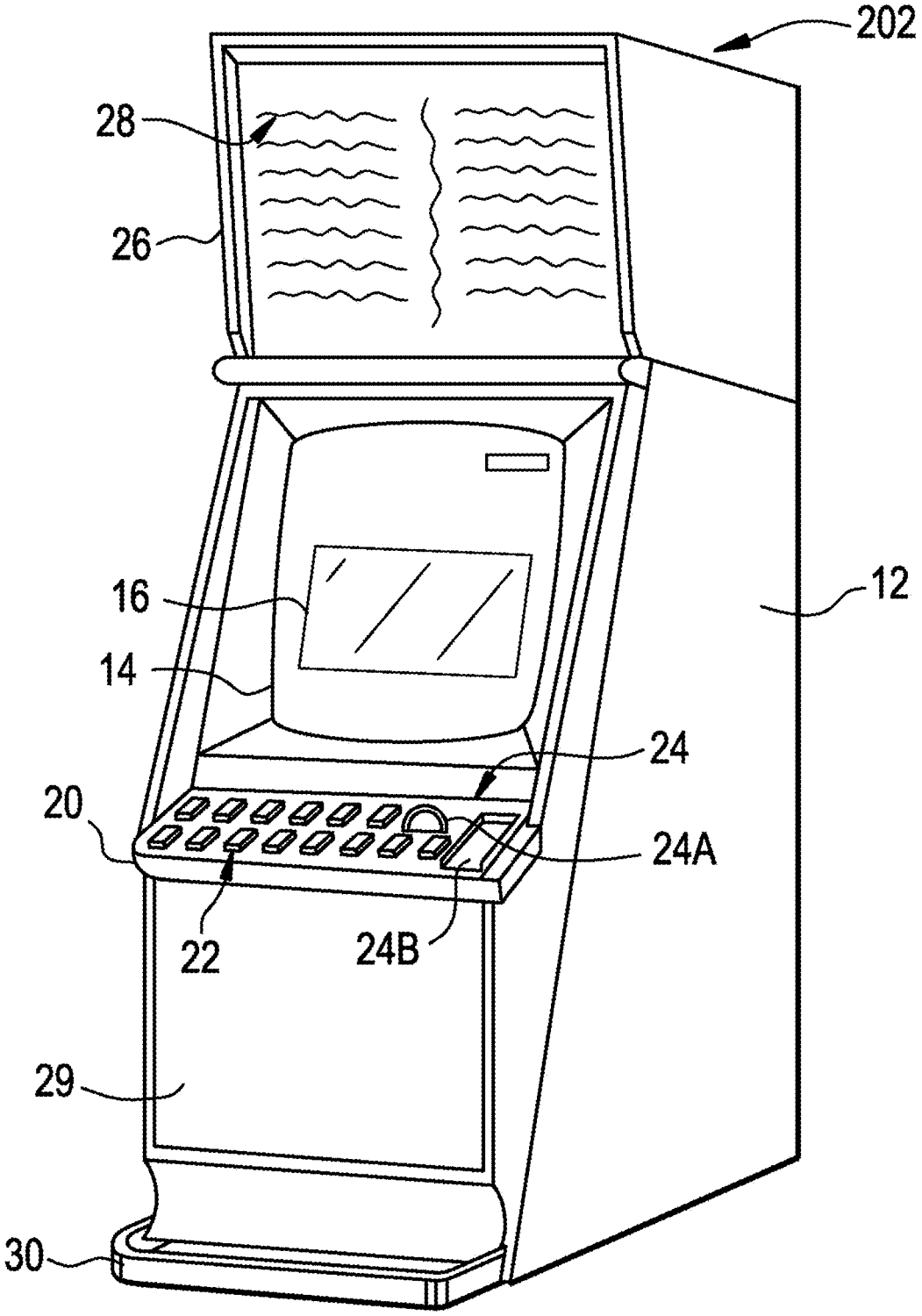
FIG. 2 is a diagrammatic representation of a gaming system in accordance with an embodiment of the present invention with the gaming system implemented in the form of a standalone gaming machine.

A gaming system in the form of a standalone gaming machine 10 is illustrated in FIG. 2. The gaming machine 10 includes a console 12 having a display 14 on which is displayed representations of a game 16 that can be played by a player. A mid-trim 20 of the gaming machine 10 houses a bank of buttons 22 for enabling a player to interact with the gaming machine, in particular during gameplay. The mid-trim 20 also houses a credit input mechanism 24 which in this example includes a coin input chute 24A and a bill collector 24B. Other credit input mechanisms may also be employed, for example, a card reader for reading a smart card, debit card or credit card. A reading device may also be provided for the purpose of reading a player tracking device, for example as part of a loyalty program. The player tracking device may be in the form of a card, flash drive or any other portable storage medium capable of being read by the reading device.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The primary display 14 shown in FIG. 2 is in the form of a video display unit, particularly a cathode ray tube screen device. Alternatively, the primary display 14 may be a liquid crystal display, plasma screen, any other suitable video display unit, or the visible portion of an electromechanical device. The top box 26 may include a secondary display, for example a video display unit, which may be of the same type as the display 14, or of a different type. In embodiments, the secondary display is configured to display artwork 28 such that the artwork is dynamically interchangeable.

Figure 3:
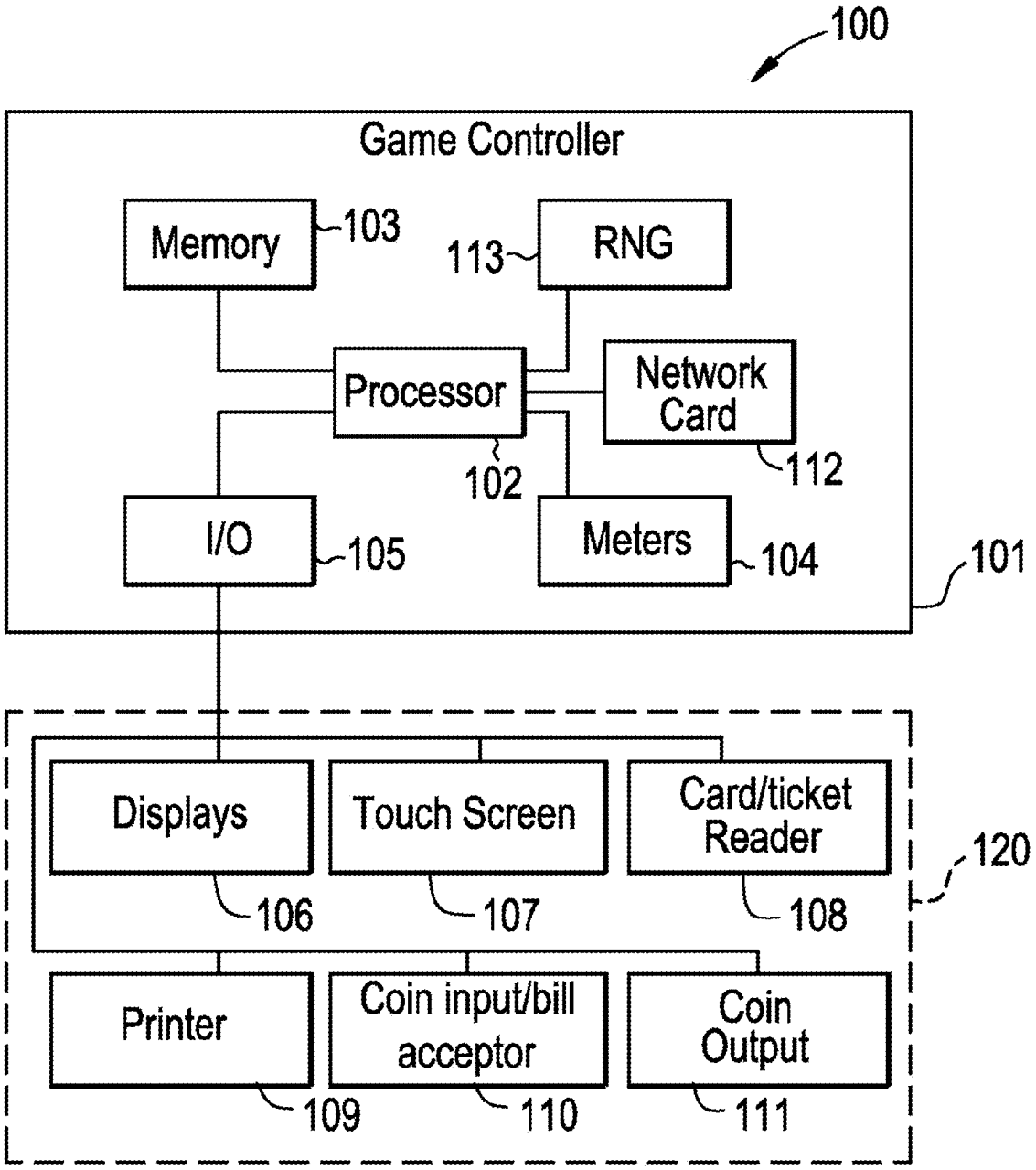
FIG. 3 is a schematic block diagram of operative components of the gaming machine shown in FIG. 2.

FIG. 3 shows a block diagram of operative components of a typical gaming machine which may be the same as or different to the gaming machine of FIG. 2.

The gaming machine 100 includes a game controller 101 having a processor 102. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 include one or more displays 106, a touch screen 107, a card and/or ticket reader 108, a printer 109, a bill acceptor and/or coin input mechanism 110 and a coin output mechanism 111. Additional hardware may be included as part of the gaming machine 100, or hardware may be omitted based on the specific implementation.

In addition, the gaming machine 100 may include a communications interface, for example a network card 112. The network card may, for example, send status information, accounting information or other information to a central controller, server or database and receive data or commands from the central controller, server or database.

Figure 4:
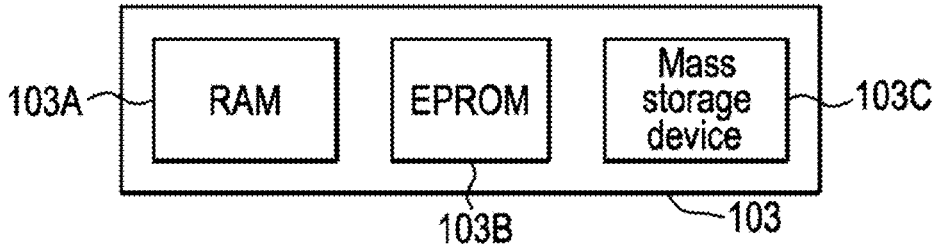
FIG. 4 is a schematic block diagram of components of a memory of the gaming machine shown in FIG. 2.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

In some embodiments, it is also possible for the operative components of the gaming machine 100 to be distributed, for example input/output devices 106,107,108,109,110,111 to be provided remotely from the game controller 101.

Figure 5:
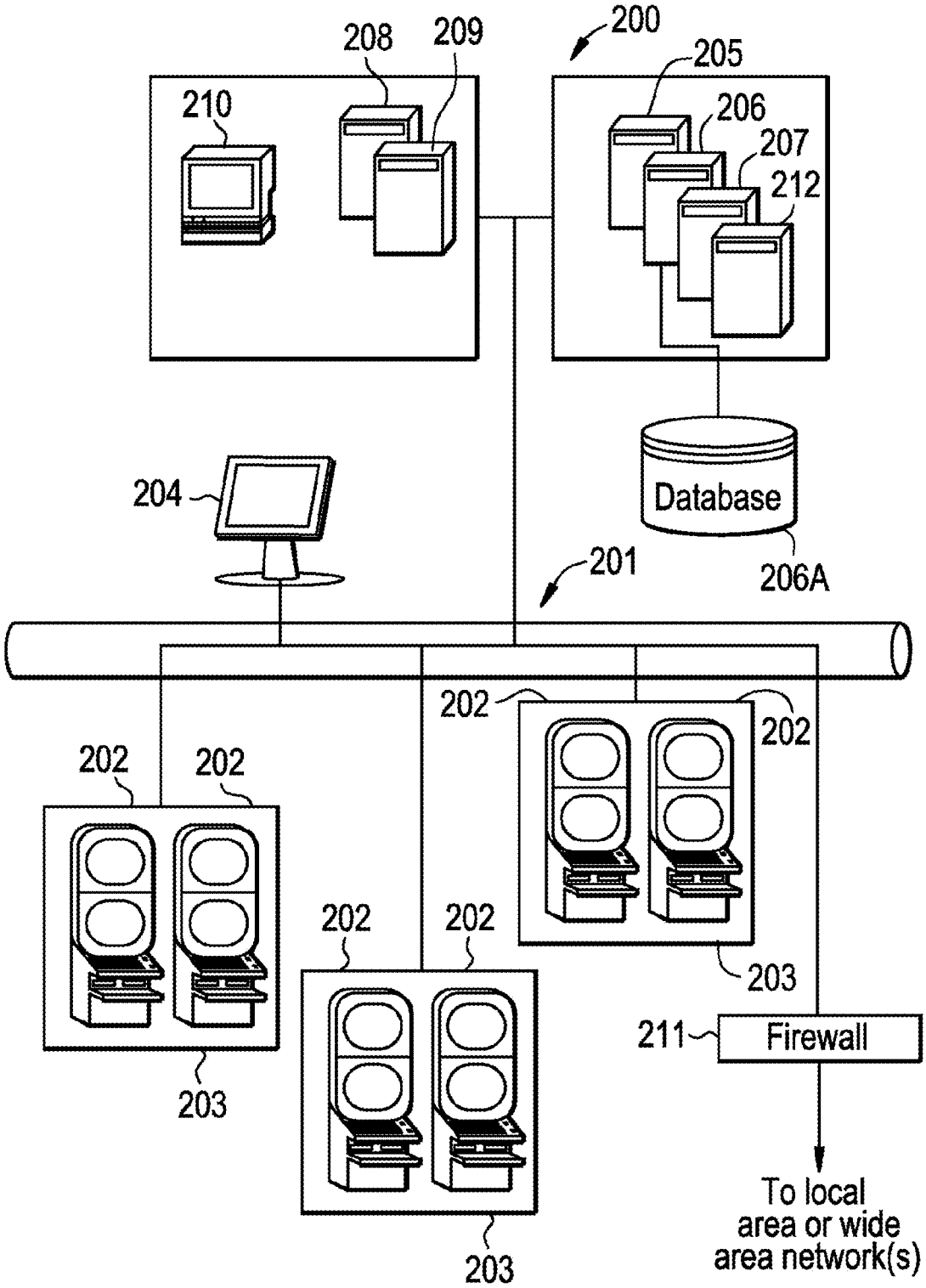
FIG. 5 is a schematic diagram of a gaming system in accordance with an alternative embodiment of the present invention with the gaming system implemented over a network.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player an operable interface and may be the same as the gaming machines 10, 100 shown in FIGS. 2 and 3, or may have simplified functionality depending on the requirements for implementing game play. In other embodiments, the interface or additional interfaces are located remote of the gaming machines 10, 100 or 202 shown in the drawings. While banks 203 of two gaming machines are illustrated in FIG. 5, banks of one, three or more gaming machines are also envisaged.

One or more displays 204 may also be connected to the network 201. The displays 204 may, for example, be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to monitor and carry out the Jackpot game.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming network 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of games servers could be provided to run different games or a single game server may run a plurality of different games depending upon the terminals.

Figure 6:
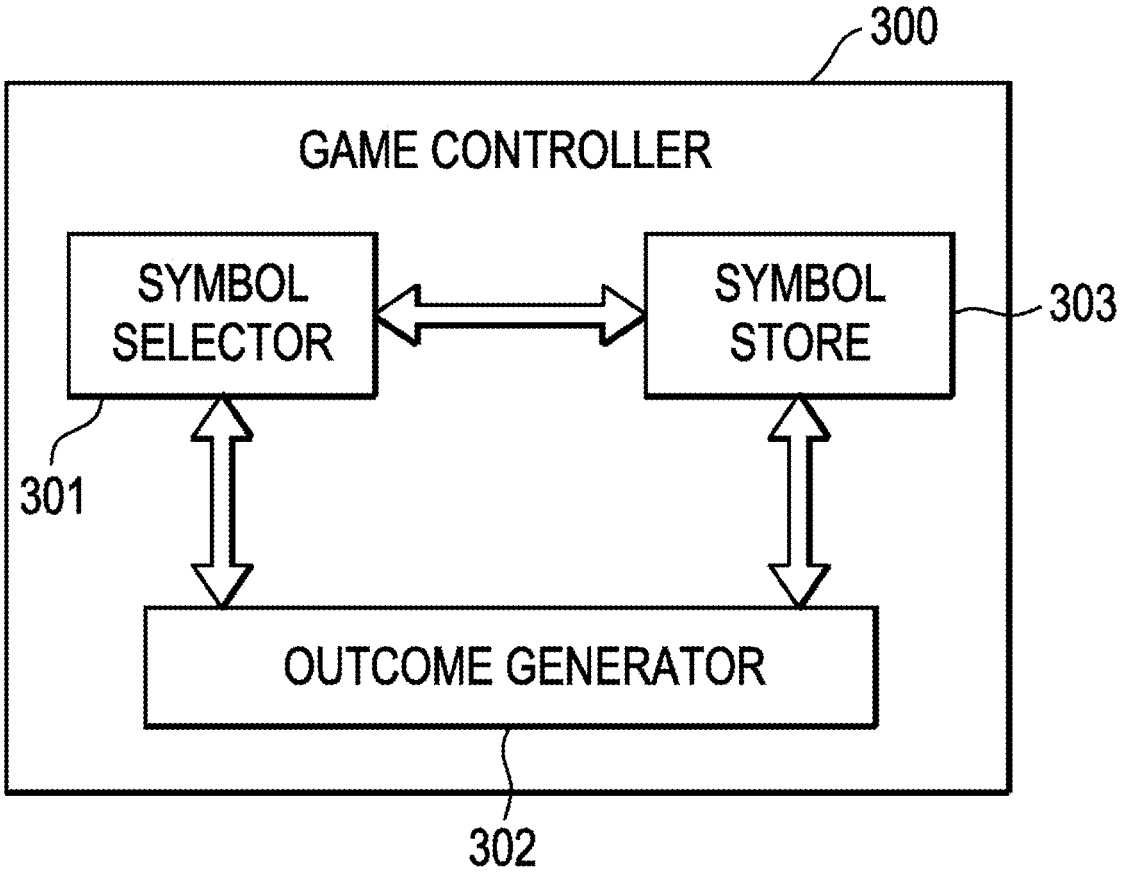
FIG. 6 is a schematic diagram of functional components of a gaming system in accordance with an embodiment of the present invention.

Now referring to FIG. 6, the functionality of an embodiment of the present invention may be implemented by a game controller 300 having the functional components illustrated. In these embodiments, the functional components are implemented utilizing a processor and memory (such as processor 102 and memory 103 in FIG. 3, or processor 62 and memory 64 in FIG. 1, or the game server 205 of FIG. 5) and associated programming. Other implementations are envisaged. For example, the functional blocks of FIG. 6 may be implemented in hardware or as separate units, or a combination of hardware and software as separate units. Any practical implementation of these functional units may be employed.

Still referring to FIG. 6, the game controller 300 includes a symbol selector 301 which is arranged to select a plurality of symbols from a set of symbols stored in the symbol store 303. In this embodiment, an outcome generator 302 determines a base game outcome based on the symbols selected by the symbol selector 301. In the normal course of a game, these symbols are displayed on the display (54 of FIG. 1, 16 of FIG. 2, 106 of FIG. 3 and 204 of FIG. 5). In this embodiment, the selected symbols are displayed as a plurality of virtual reels on a video display, having lines and rows. Alternatively, the display may include a stepper motor and physical reels.

In this embodiment, the outcome of the base game depends on the selected symbols appearing on the display and may include a win outcome, loss outcome, trigger outcome, or feature outcome or any other outcome. Outcomes may be determined on the basis of symbols appearing in the one or more horizontal lines, diagonal lines, or any other predetermined combination, as will be known by those skilled in the art.

Figure 7:
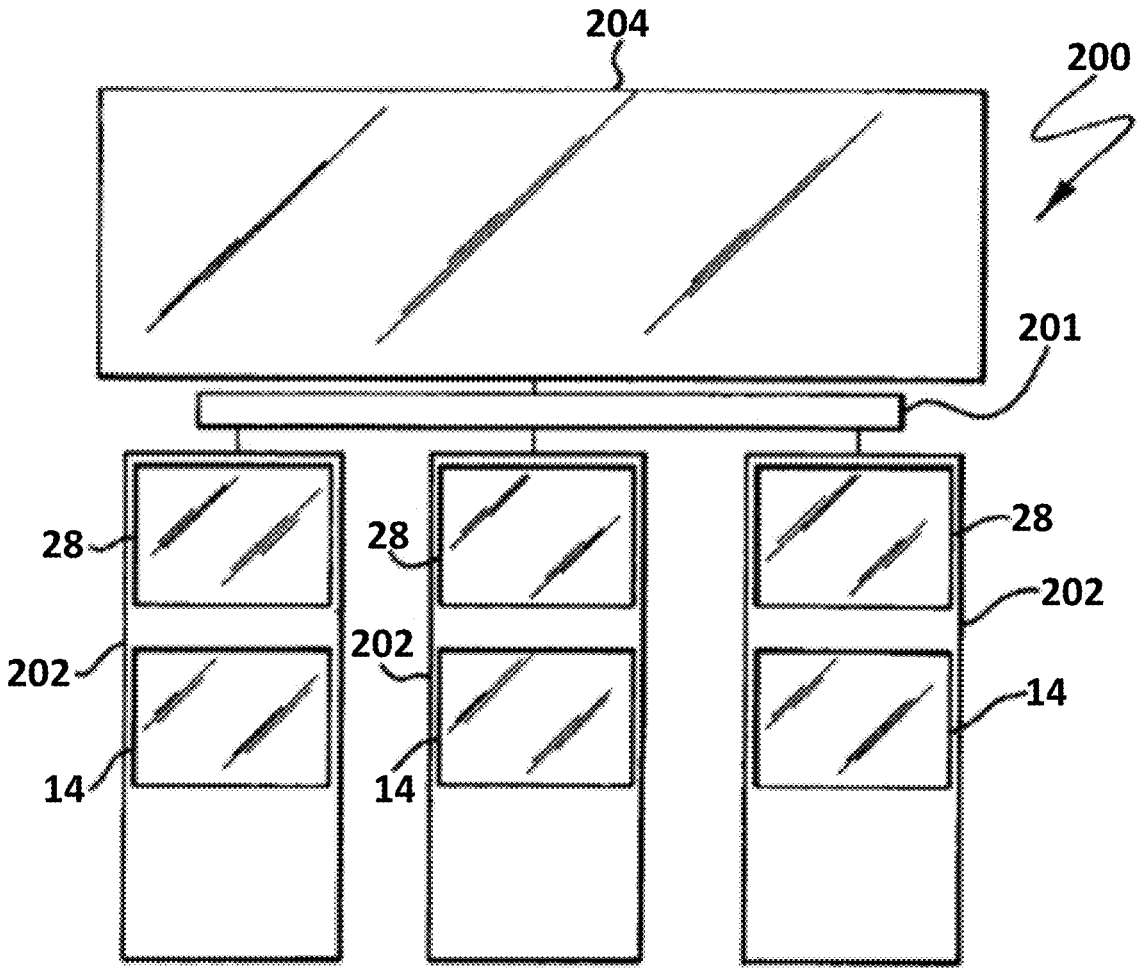
FIG. 7 is an physical representation of the embodiment of the invention shown in FIG. 5.

A physical representation of the embodiment shown in FIG. 5 is depicted in FIG. 7. Gaming machines 202 forms part of a gaming machine system 200. The system 200 comprises a plurality of gaming machines 202 each of which, as shown in FIG. 2, includes a primary display 14 and a secondary display for displaying artwork 28.

The system 200 further includes a third, remote screen display or screen 204 to which each of the gaming machines 202 is connected via the network 201. The remote screen 204 may be visible to each player on any one of the gaming machines 202 of the system 200 and also to spectators that may not be playing any of the gaming machines.

The gaming machines 202 are also linked to the game server 205. In embodiments, the game server is configured to monitor what is displayed on the remote screen 204 and also to monitor progressive jackpot values and distributions as for a standard linked progressive jackpot system.

In some embodiments, when the gaming machines 202 are not being played or the feature has not been triggered, an attract mode, which is themed to the base game, is displayed on the secondary display 28 in the top box 26 of each gaming machine 202. Further, while the base game is being played on the gaming machines 202 or the gaming machines 202 are not being played, an attract mode of the theme is displayed on one of the displays 16 or 28 of the gaming machine 202 and/or on the remote screen 204.

An example embodiment of a system and method for redeeming a prize will now be described with reference to FIGS. 8 to 10. Unless otherwise stated, the examples discussed below refer to an embodiment of the invention implemented on the gaming system having a standalone gaming machine, such as the embodiment shown in FIGS. 2 and 3 discussed above. Those skilled in the art will appreciate that embodiments of the invention may readily be implemented on gaming systems having multiple gaming machines, such as those shown in FIGS. 5 and 7 discussed above.

Figure 8:
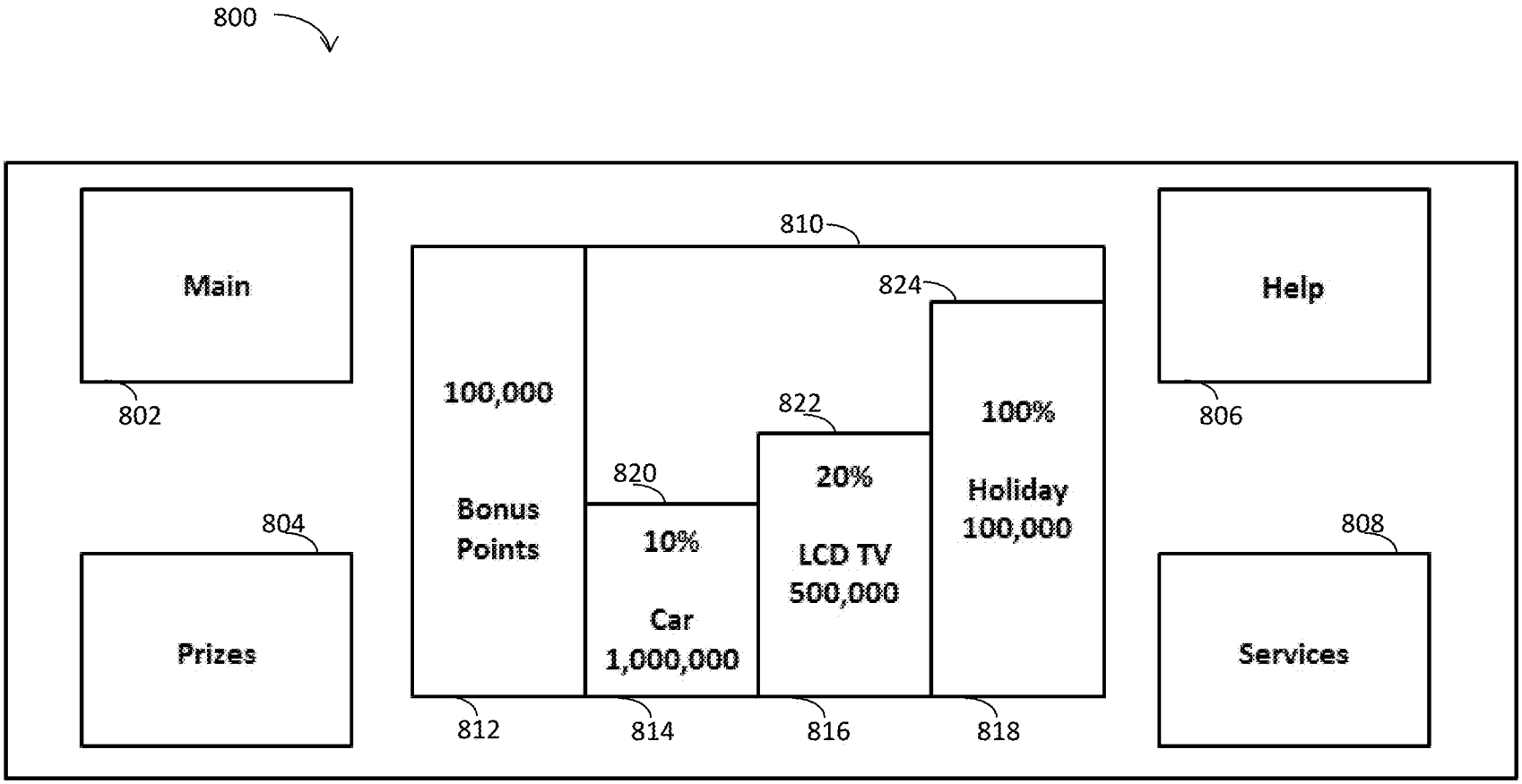
FIG. 8 is a representation of a display of a gaming system in accordance with an embodiment of the present invention.

Referring to FIG. 8, a representation 800 of a display 14 of the gaming machine 202 is shown. In this embodiment, the display 800 comprises a user interface in the form of touchscreen buttons "main" 802, "prizes" 804, "help" 806 and "services" 808; although it will be appreciated that the user interface will be implemented in a different in other embodiments. For example, in an embodiment, the user interface may be implemented externally of the gaming machine 202 as a remote installation. Such an installation is envisaged for the embodiment shown in FIG. 7, in which a common display 204 is shared among multiple players and is also viewable by non-players.

Returning to FIG. 8, display 800 also comprises prize information area 810 for displaying information about the prizes available for redemption. In this embodiment, this information is presented in the form of a column graph, although it will be appreciated by those skilled in the art that the information may be presented in any format convenient.

The prize information area 810 comprises a "bonus points" column 812, which is indicative of the points balance accumulated by the player. The points balance is available to the player for redeeming a reward from any eligible prize bucket, which is discussed further below. In the case of FIG. 8, the points balance of the player is 100,000 points.

The prize information area 810 also comprises a plurality of prize buckets 814, 816, and 818, which are indicative of the prizes that the player may selectively redeem, as well as a predefined redemption threshold of points for that prize. For example, in the FIG. 8 embodiment, the prize bucket 814 is associated with a car having a prize redemption threshold of 1,000,000 points. Similarly, prize bucket 816 is associated with an LCD TV having a prize redemption threshold of 500,000 points, and prize bucket 818 is associated with a holiday having a prize redemption threshold of 100,000 points.

Furthermore, representations of the prize buckets also include a relative prize level indicator, which provides relative visual information regarding the player's progress towards eligibility to redeem a reward from one of the prize buckets. In embodiments, the relative prize level indicator is determined by calculating the percentage of points relative to the prize redemption threshold. Thus continuing on with the embodiment of FIG. 8, the prize redemption threshold for bucket 814 is 1,000,000 points while as shown in column 812, the player has only accumulated 100,000 points. Accordingly, the player has made a 10% progression towards the prize redemption threshold of prize bucket 814. This information is reflected in the form of prize level indicator 820, which is shown relative to the other prize buckets 816 and 818 as well as the total points balance column 812. Similarly, the player has made a 20% progression towards the prize redemption threshold of bucket 816 and has accumulated enough points to reach 100% of the prize redemption threshold for bucket 818. This information is reflected visually by prize level indicators 822 and 824, respectively. In some embodiments, the percentage progression is indicated on the display in addition to the points level indicators, such as shown in FIG. 8. Other embodiments may rely entirely on relative visual information.

In the preferred embodiment, a prize is redeemable from a prize bucket once the player reaches 100% of the prize redemption threshold for the bucket. Thus in FIG. 8, the player is eligible to selectively redeem the holiday prize associated with bucket 818. If the player chooses not to immediately redeem the holiday prize, he may continue accruing points and progress towards collecting points to redeem prizes from buckets 814 or 816, which contain higher value prizes. Thus it will be appreciated that players are always kept aware of 1) what their points balance is, 2) what prizes they are eligible to redeem, and 3) their progression towards eligibility for a higher value prize.

To further ensure that a player is kept aware that prize redemption is now available, some embodiments provide for a notification to be sent to the player once the player becomes eligible to redeem a prize form a prize bucket. This notification can be audible, visual, or both. Audible alarms include chimes or bells or any suitable sound commonly associated with a notification, or being awarded and award. Visual alarms may include one or more of a message a flashing of the prize level indicators, a changing of colours of at least one element displayed on the display or any other suitable visual effect commonly associated with a notification, or being awarded and award. In other embodiments, the visual and audible notifications are associated with one or more specific prizes and proportionate to the value of the prizes such that notifications convey some meaning to the player and other spectators. For example, winning a jackpot or a car may be associated with a venue-wide notification so that patrons will know immediately that a jackpot or a car has been won.

Note that, in the FIG. 8 embodiment, each prize bucket is shown associated with only one prize for the sake of simplicity. However, it should be appreciated that each bucket will typically be associated with multiple prizes in other, more preferable embodiments. As well, prizes and redemption thresholds indicated in the Figures are chosen for explanatory purposes only.

Figure 9A:
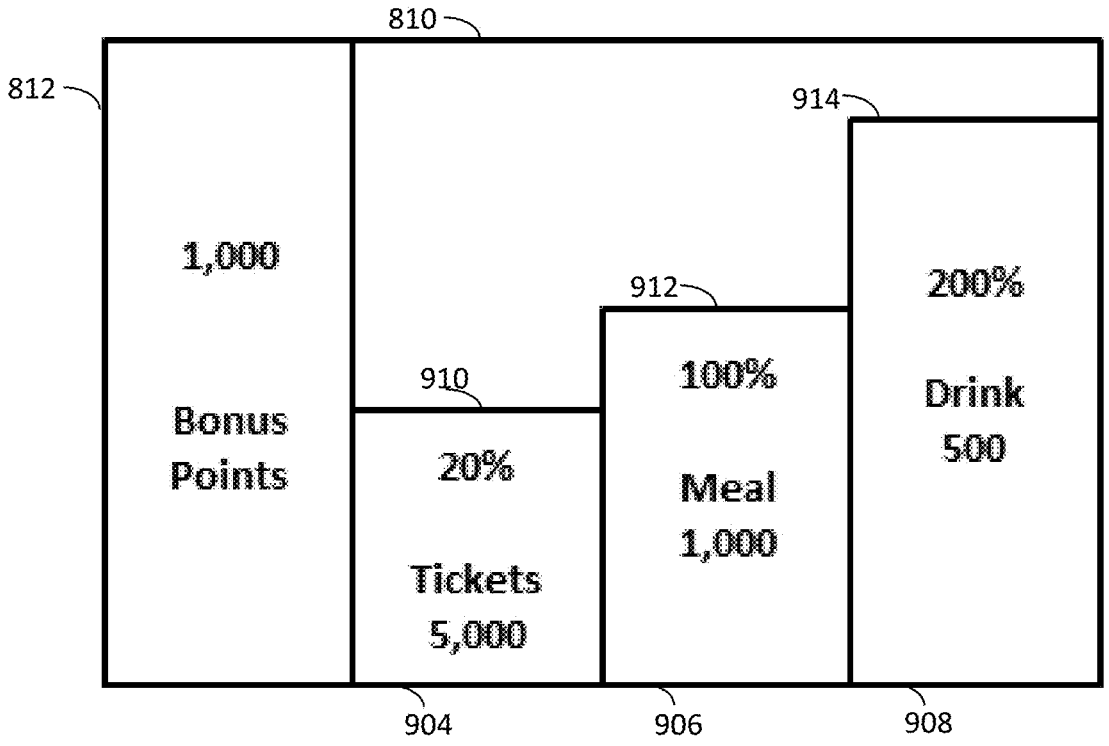

In some embodiments, the prize level indicator continues to accumulate even after a player reaches 100% of the prize redemption threshold. This is particularly true for low value prize buckets, as best shown in FIG. 9*a*. In that example, the player has a points balance of 1,000 points, as indicated in bonus points column 812. However, since the prize redemption threshold for prize bucket 908 is only 500 points, the player in this scenario has enough points to selectively redeem two drinks. This information is reflected in FIG. 9*a* by relative points level indicator 914 and the percentage progression information of 200%. Alternatively, the player can select to redeem one drink immediately and contribute the remaining points to the other prize buckets 904 or 906.

There is no theoretical limit on the number of points the player may accumulate, and so it is feasible that the player accumulates many multiples of the prizes available in a prize bucket. This is exemplified in a scenario where the player is intent on a higher value prize bucket. Referring again to FIG. 9*a*, a player may be intent on redeeming the "tickets" prize, which has a prize redemption threshold of 5,000 points. Thus when the player accumulates 5,000 points, the prize level indicator 910 for bucket 904 will indicate 100%, allowing the player to redeem the tickets prize from prize bucket 904.

Figure 9B:
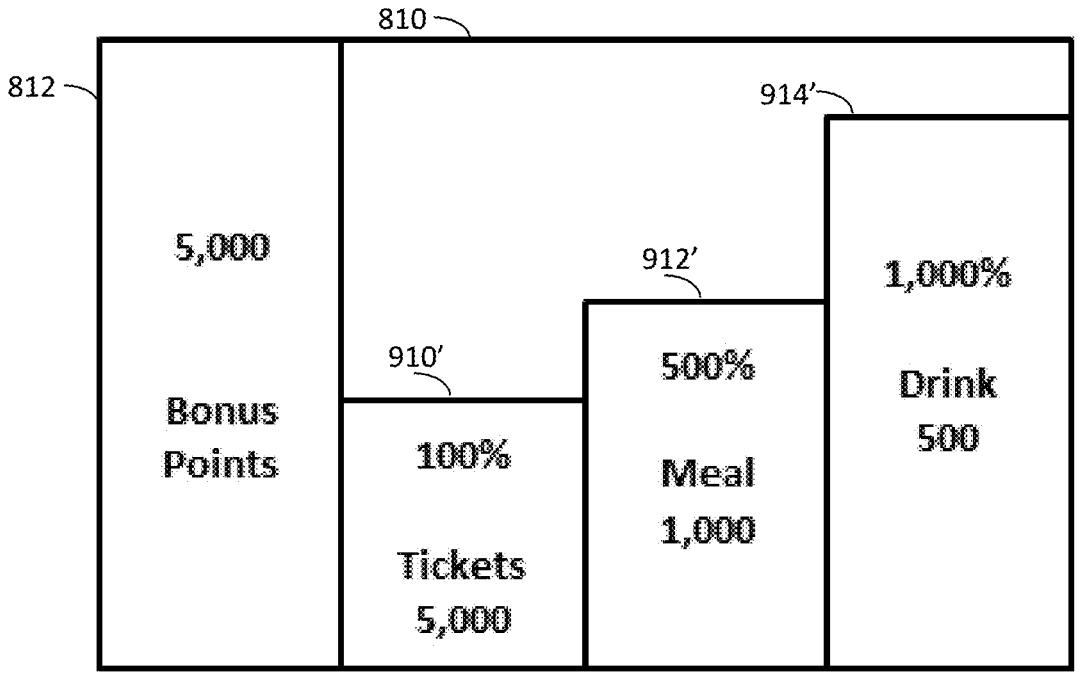

At the 5,000 points level, however, the player will also have accumulated enough points to redeem 5 meals or 10 drinks, or any combination thereof, from prize buckets 906 and 908. To accommodate this information, some embodiments of the prize information area 810 automatically adjust and resize the representations of the prize buckets such that the respective prize level indicators remain displayed visually relative to each other and to the bonus points column 812. An example of this is shown in FIG. 9*b*, where the prize level indicators 910', 912' and 914' have been resized to remain displayed visually relative to each other, but indicate respectively 100%, 500% and 1,000% of the prize redemption threshold of buckets 904, 906 and 908.

Note that this embodiment envisages a common accumulation rate for bonus points, with the points balance displayed in the bonus points column 812. However, those skilled in the art will appreciate that accumulation rates will differ between prize buckets in other embodiments. For example, bonus points for more desirable prizes such as those associated with prize bucket 904 may have a slower accumulation rate than for less desirable prizes, such as those associated with prize buckets 906 or 908. In such an embodiment, the respective prize redemption thresholds may also be adjusted lower in conjunction with different accumulation rates so that eligibility for redeeming higher value and lower value prizes is not too inequitably distributed.

Figure 9C:
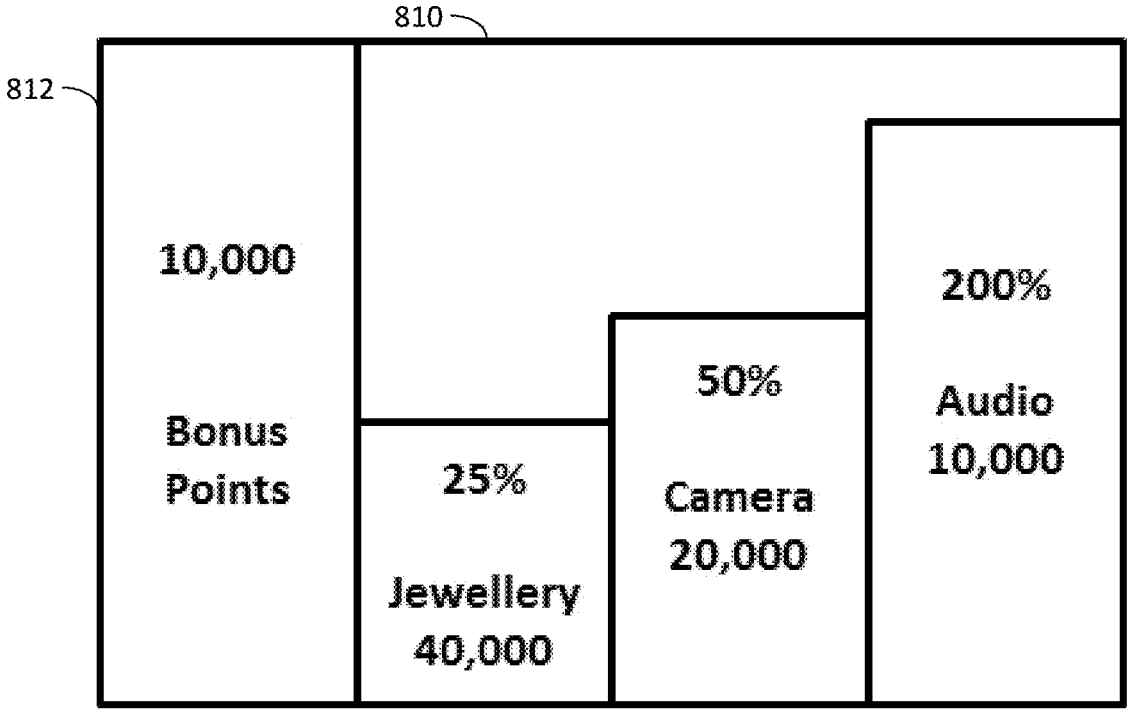
Figure 9D:
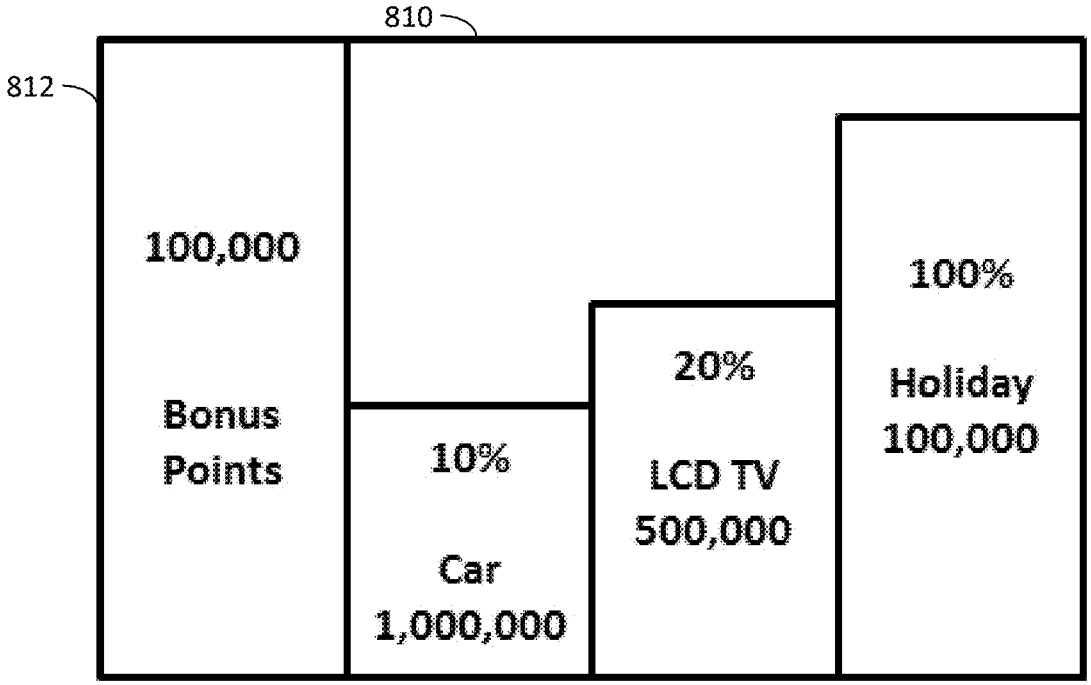

In embodiments, the gaming system 200 includes a plurality of prize bucket profiles. For example, FIGS. 9*a* and 9*b* illustrate a low value prize bucket profile while FIG. 9*c* illustrates a mid-value prize bucket profile and FIG. 9*d* illustrates a high value prize bucket profile. In an embodiment, the gaming system 200 automatically assigns a prize profile to a player based on some predefined criteria, for example the player's gaming history, which may be collected through various player tracking means generally known in the art. Thus when the player is identified, the gaming system 200 can readily ascertain for example whether the player has a large existing bonus points balance, and can assign a prize bucket profile on this basis. In this example, the gaming establishment may be concerned that the points balance creates too much of an overhang liability, and so encourages the player to spend the points by assigning the mid value or low value prize bucket profile. The player will see that many prizes are already eligible for redemption from various prize buckets, and be encouraged to redeem his or her points.

Alternatively, the gaming system 200 may ascertain that a player is close to being able to redeem a highly desirable prize, such a car associated with prize bucket 814, and assign the high value prize bucket to the player. The player will then see that the prize associated with prize bucket 814 is close to being redeemable and that he or she is close to winning a car. This will encourage the player to continue playing and accumulate more points.

In other embodiments, the player is offered the opportunity to select a suitable prize bucket profile, for example when he or she registers with the player's club of the gaming establishment or at the beginning of play of a game. In this or further embodiments, certain prize bucked profiles may be unavailable until the player meets certain criteria. For example, the high value prize bucket profile may not become available until the player has wagered a certain number of credits. This may be implemented by a tiered approach whereby the player must initially select the low value profile until a first value of credits have been wagered before the mid value profile becomes available. The player must then select the mid value profile and wager a second value of credits before the high value profile becomes available.

As mentioned above, the representation 800 of the FIG. 8 embodiment comprises a user interface in the form of touchscreen buttons "main" 802, "prizes" 804, "help" 806 and "services" 808. In this embodiment, the interface is implemented in the form of a touchscreen and shares a display with the prize information area, which may be the primary display 14 of the gaming machine 202. In that case, the primary display 14 normally displays the base game 16, such as the symbol selection game discussed above. A predefined action by the player causes the gaming machine to exit or pause the game 16 and display the representation 800.

In embodiments, representation 800 is implemented in the form of a window that overlays the base game 16. Alternatively, base game 16 may be "minimised" and representation 800 may be displayed in its place. Other variations will be readily understood by those skilled in the art. Similarly, when a player touches one of the touchscreen buttons 802, 804, 806 or 808 on the interface, a new screen is displayed in place of or over representation 800. Thus for example when a player touches the help button 806, a help screen regarding the base game 16 or regarding the prize redemption system and method appears. When a player touches services button 808, information regarding services available will appear. Some embodiments will allow players to request or purchase services by pressing services button 808. For example, the player may be able to request a drink, or to transfer player credits to and from their player account. The main button 802 returns the player to the base game 16.

When the player touches the prizes button 804 on the representation 800, prize description screen 1000 is caused to be displayed on the primary display, as shown in FIG. 10. If Prize description screen 1000 will typically display a picture of the prize, in this example a car 1002, the prize redemption threshold 1004 and a brief description of the prize 1006. This embodiment of the prize description screen also includes a prize level indicator 1008, which reformats the information shown in prize information area 810 for prize bucket 814. As shown, the player has only reached 85% of the prize redemption threshold for the car and consequently, the redeem button 1010 is greyed out and deactivated. If the player had reached 100%, the player would be eligible to redeem the prize and the redeem button 1010 would be solid.

In an alternative embodiment, shown in FIG. 11, touching the prizes button 804 would cause sub-interface 1100 to be displayed. The player may then choose to view the description screen by touching description button 1102, or to redeem the prize by touching redemption button 1104. In that case, the prize description screen would be similar to prize description screen 1000 discussed in relation to FIG. 10, but would not include the redeem button 1010.

In further embodiments, the prize information area 810 covers the entirety of a display. Such an embodiment is envisaged in relation to the embodiment shown in FIG. 7, where the prize information area 810 is displayed on the common display 204. For practical reasons, the interface in this embodiment does not share the common display 204 with the prize information area 810. This embodiment is particularly useful for facilitating team games or the like whereby players playing on a bank 203 of gaming machines 202 are assigned to a team and collectively accumulate points towards one or more shared prize buckets. In such a team game, a team reaching a prize redemption threshold may be eligible to share a prize associated with the prize bucket, such as a jackpot. In other embodiments, each player may individually be eligible to selectively redeem one of the eligible prizes associated with a prize bucket.

Instead of sharing the display 204, the interface may be implemented on one of displays 16 or 28 of a gaming machine 202, or in other embodiments located remotely from the gaming machines 202. Such an embodiment is advantageous in accommodating non-players who have an existing points balance. For example a player may wish to redeem his or her points for tickets to see a show playing in gaming premises. In general, the interface may be implemented in a variety of manners as will be apparent to those skilled in the art, and all should be considered to fall within the spirit and scope of the present invention.

In these and other embodiments, a player must operate the interface before prize information area 810 is displayed. Thus the prize information area 810 is not permanently displayed, and is only displayed on demand. Furthermore, the prize information area 810 reverts to the base game 16 after a predefined period of time. This feature prevents a player wasting too much time tying up a gaming machine "shopping" for prizes in embodiments where the interface uses the primary display 14 of a gaming machine 202. Furthermore, interface buttons may be deactivated for a predefined period of time based on certain criteria, for example, spending too much time in the prize description screen.

An embodiment of one method for redeeming a prize in a gaming establishment is presented in the flowchart shown in FIG. 12. Initially, a plurality of prize buckets are displayed on a display at step 1202, each of the plurality of prize buckets being associated with at least one prize. A plurality of prize level indicators, each being associated with a respective one of the plurality of prize buckets is then displayed at step 1204. As the player patronizes the gaming establishment, reward points are accumulated based on at least one criterion—for example play of a specific game—at step 1206. Using the accumulated rewards points, the gaming system determines a percentage of points as a proportion of the predefined redemption threshold at step 1208, and uses the determined percentage to dynamically adjust the displayed prize level indicators at step 1210, so that the plurality of prize level indicators is each indicative of a progression towards eligibility to redeem a respective one of the associated plurality of prize buckets. As step 1212, the gaming system monitors the plurality of prize level indicators and determines, at step 1214, when at least a first of the plurality of prize level indicators reach the predefined redemption threshold of points. In response, at step 1216, the gaming system then allows the associated first prize to be selectively redeemable from the prize bucket associated with that first prize level indicator to be. Alternatively, if the prize level indicators have not reached the predefined redemption threshold of points, the method returns to step 1206 and continually accumulates points based on the at least one criterion. Also, even after a prize becomes redeemable from a prize bucket after step 1216, the method returns to step 1206 so that the player may accumulate more points to become eligible for additional, higher value prize buckets.

Accordingly, it is an advantage of the invention that provides a system and method for redeeming a prize which encourages a player to redeem rewards points balances more frequently thus reducing the overhang liability to the gaming establishment. Another advantage is that the system and method encourages players to continue playing to progress towards eligibility to redeem higher value prizes. This is a result of the prize information area 810 being visible, so that players of the gaming machines 10, 202 may readily discern progress being made towards redeeming prizes from certain prize buckets While the invention has been described with reference to one or more preferred embodiments, those skilled in the art will understand that changes may be made and equivalents may be substituted without departing from the spirit and the scope of the invention. In addition, many modifications may be made to adapt a particular step, structure, or material to the teachings of the invention without departing from its scope. Therefore, it is intended that the invention not be limited to the particular embodiment disclosed, but that the invention will include all embodiments falling within the scope of the appended claims

The invention claimed is:

1. A method of visually notifying one of a plurality of prizes being redeemable during play of a plurality of games on at least one gaming machine comprising an interface interactively operable to receive a selection of one of the plurality of prizes, an electronic video display, and a game controller comprising a processor and memory, the memory storing instructions, which, when executed, cause the game controller to initiate at least one of the plurality of games, the method comprising:

displaying on the electronic video display a plurality of visual prize identifiers associated with the plurality of prizes including a first visual prize identifier having a first balance and a second visual prize identifier having a second balance, the first balance and the second balance indicating eligibilities to redeem a first prize and a second prize of the plurality of prizes associated with the first visual prize identifier and the second visual prize identifier, respectively;

displaying on the electronic video display a plurality of visual prize level thresholds associated with the plurality of visual prize identifiers, the plurality of visual prize identifiers having a plurality of accumulation rates, respectively, wherein a first accumulation rate of the plurality of accumulation rates is different from a second accumulation rate of the plurality of accumulation rates;

displaying on the electronic video display a plurality of reward points being accumulated based on a predefined criterion during the play of at least one of the plurality of games;

displaying on the electronic video display the first balance associated with the first visual prize identifier being visually accrued to a different first balance based on the plurality of reward points accumulated at the first accumulation rate, and concurrently the second balance associated with the second visual prize identifier being visually accrued to a different second balance based on the plurality of reward points accumulated at the second accumulation rate that is different from the first accumulation rate;

displaying on the electronic video display the first prize associated with the first visual prize identifier being unlocked to become a player selectable prize interactively selectable when the different first balance reaches a first visual prize level threshold associated with the first visual prize identifier; and displaying on the electronic video display the first visual prize identifier being visually resized when the different first balance exceeds the first visual prize level threshold.

2. The method of claim 1, further comprising:

assigning a first set of the plurality of visual prize identifiers to a first group of players; and activating at least one of the plurality of prizes associated with the first set of the plurality of visual prize identifiers to be redeemable only by the first group of players.

3. The method of claim 1, further comprising notifying the at least one gaming machine indicating that the at least one gaming machine is eligible to redeem the first prize.

4. The method of claim 3, wherein notifying the at least one gaming machine includes generating at least one of an audible alarm and a visual alarm.

5. The method of claim 4, wherein the visual alarm includes at least one of: 1) a message, 2) a flashing of the first visual prize level threshold, 3) a changing of colors of at least one element displayed on the electronic video display.

6. The method of claim 1, wherein the interface further includes a first button operable to perform viewing the first prize, a second button operable to perform displaying a prize description, and a third button operable to perform sending a redemption instruction to selectively redeem the first prize.

7. The method of claim 1, wherein the predefined criterion comprises at least one of: 1) a length of time played on the at least one gaming machine, 2) a player history, 3) a type of game played, and 4) an amount of time played in a gaming establishment.

8. The method of claim 1, further comprising displaying the plurality of reward points being accumulated on the electronic video display concurrently with respective balances of the plurality of visual prize level thresholds.

9. A system of visually notifying one of a plurality of prizes being redeemable based on reward points accumulated during play of a plurality of games on a plurality of gaming devices, the system comprising:

an electronic video display operable to display a plurality of visual prize identifiers associated with the plurality of prizes, and a plurality of visual prize level thresholds associated with the plurality of visual prize identifiers including a first visual prize identifier having a first balance and a second visual prize identifier having a second balance, wherein the first balance and the second balance indicate eligibilities to redeem a first prize and a second prize of the plurality of prizes associated with the first visual prize identifier and the second visual prize identifier, respectively; and a game controller comprising a processor and memory, the memory storing a plurality of instructions, which, when executed, cause the game controller to initiate at least one of the plurality of games, the plurality of visual prize identifiers having a plurality of accumulation rates, respectively, wherein a first accumulation rate of the plurality of accumulation rates is different from a second accumulation rate of the plurality of accumulation rates, and cause the electronic video display to display a plurality of reward points being accumulated based on a predefined criterion during play of at least one of the plurality of games, and the first balance associated with the first visual prize identifier being visually accrued to a different first balance based on the plurality of reward points accumulated at the first accumulation rate, and concurrently the second balance associated with the second visual prize identifier being visually accrued to a different second balance based on the plurality of reward points accumulated at the second accumulation rate that is different from the first accumulation rate, the first prize associated with the first visual prize identifier being unlocked to become a player selectable prize interactively selectable when the different first balance reaches a first visual prize level threshold associated with the first visual prize identifier, and the first visual prize identifier being visually resized when the first balance exceeds the first visual prize level threshold; and an interface interactively operable to receive a player selection based on the first prize associated with the first visual prize identifier when the first balance reaches the first visual prize level threshold associated with the first visual prize identifier.

10. The system of claim 9, wherein executing the instructions further causes the game controller to assign a first set of the plurality of visual prize identifiers to a first group of players, and activate at least one of the plurality of prizes associated with the first set of the plurality of visual prize identifiers to be redeemable only by the first group of players.

11. The system of claim 9, wherein the instructions, when executed, further cause the game controller to notify to the plurality of gaming devices indicating which of the plurality of gaming devices is eligible to redeem the first prize.

12. The system of claim 11, wherein the instructions, when executed, further cause the game controller to generate at least one of an audible alarm and a visual alarm.

13. The system of claim 12, wherein the visual alarm includes at least one of: 1) a message, 2) a flashing of the first visual prize level threshold, 3) a changing of colors of at least one element displayed on the electronic video display.

14. The system of claim 9, wherein the interface further includes a first button operable to perform viewing the first prize, a second button operable to perform displaying a prize description, and a third button operable to perform sending a redemption instruction to selectively redeem the first prize.

15. The system of claim 9, wherein the predefined criterion comprises at least one of: 1) a length of time played on the plurality of gaming devices, 2) a player history, 3) a type of game played, and 4) an amount of time played in a gaming establishment.

16. The system of claim 9, wherein the instructions, when executed, further cause the game controller to control the electronic video display to display the plurality of reward points being accumulated on the electronic video display concurrently with respective balances of the plurality of visual prize level thresholds.

17. The system of claim 9, wherein the electronic video display on which the plurality of visual prize identifiers and the plurality of visual prize level thresholds are displayed is common to the plurality of gaming devices.

18. The system of claim 9, wherein at least one of the plurality of gaming devices is remotely connected to the game controller.

19. A gaming machine for visually notifying one of a plurality of prizes being redeemable during play of a plurality of games, the gaming machine comprising:

an electronic video display operable to display a plurality of visual prize identifiers associated with the plurality of prizes including a first visual prize identifier having a first balance and a second visual prize identifier having a second balance, wherein the first balance and the second balance indicate eligibilities to redeem a first prize and a second prize of the plurality of prizes associated with the first visual prize identifier and the second visual prize identifier, respectively, and a plurality of visual prize level thresholds associated with the plurality of visual prize identifiers;

a game controller comprising a processor and memory, the memory storing a plurality of instructions, which, when executed, cause the game controller to initiate at least one of the plurality of games, the plurality of visual prize identifiers having a plurality of accumulation rates, respectively, wherein a first accumulation rate of the plurality of accumulation rates is different from a second accumulation rate of the plurality of accumulation rates, cause the electronic video display to display a plurality of reward points being accumulated based on a predefined criterion during play of at least one of the plurality of games, and the first balance associated with the first visual prize identifier being visually accrued to a different first balance based on the plurality of reward points accumulated at the first accumulation rate, and concurrently the second balance associated with the second visual prize identifier being visually accrued to a different second balance based on the plurality of reward points accumulated at the second accumulation rate that is different from the first accumulation rate, and the first visual prize identifier being visually resized when the first balance exceeds a first visual prize level threshold; and an interface interactively operable to receive a player selection based on the first prize associated with the first visual prize identifier when the first balance reaches the first visual prize level threshold associated with the first visual prize identifier.

20. The gaming machine of claim 19, wherein the instructions, when executed, further cause the game controller to notify the first prize is redeemable.

21. The gaming machine of claim 20, wherein the instructions, when executed, further cause the game controller to generate at least one of an audible alarm and a visual alarm.

22. The gaming machine of claim 21, wherein the visual alarm includes at least one of: 1) a message, 2) a flashing of the first visual prize level threshold, 3) a changing of colors of at least one element displayed on the electronic video display.

23. The gaming machine of claim 19, wherein the interface further includes a first button operable to perform viewing the first prize, a second button operable to perform displaying a prize description, and a third button operable to perform sending a redemption instruction to selectively redeem the first prize.

24. The gaming machine of claim 19, wherein the predefined criterion comprises at least one of: 1) a length of time played on the gaming machine, 2) a player history, 3) a type of game played, and 4) an amount of time played in a gaming establishment.

* * * * *